US006866770B2

(12) United States Patent
Costa

(10) Patent No.: US 6,866,770 B2
(45) Date of Patent: Mar. 15, 2005

(54) PROTECTIVE GROUND MAT FOR INDUCED POTENTIALS AND METHOD THEREFOR

(75) Inventor: Jorge E. Costa, Tequesta, FL (US)

(73) Assignee: Corrosion Restoration Technologies, Inc., Jupiter, FL (US)

( * ) Notice: Subject to any disclaimer, the term of this patent is extended or adjusted under 35 U.S.C. 154(b) by 437 days.

(21) Appl. No.: 10/171,281

(22) Filed: Jun. 12, 2002

(65) Prior Publication Data

US 2003/0230494 A1 Dec. 18, 2003

Related U.S. Application Data

(60) Provisional application No. 60/385,382, filed on Jun. 3, 2002.

(51) Int. Cl.[7] ..... C23F 13/00

(52) U.S. Cl. ..... 205/734; 205/740; 205/733; 205/730; 204/196.21; 204/196.36; 204/196.37

(58) Field of Search ..... 204/196.21, 196.36, 204/196.37; 205/730, 733, 734, 740

(56) References Cited

U.S. PATENT DOCUMENTS

| | | | | |
|---|---|---|---|---|
| 2,982,705 A | | 5/1961 | Sakano et al. | |
| 4,114,977 A | | 9/1978 | Polidori | 339/270 |
| 4,388,594 A | * | 6/1983 | Deskins et al. | 324/348 |
| H544 H | * | 11/1988 | Castillo et al. | 205/734 |
| 5,139,634 A | * | 8/1992 | Carpenter et al. | 205/727 |
| 5,340,455 A | * | 8/1994 | Kroon et al. | 204/196.3 |
| 5,478,451 A | | 12/1995 | Riffe | 204/147 |
| 5,586,213 A | * | 12/1996 | Bridges et al. | 392/312 |
| 5,714,045 A | | 2/1998 | Lasa et al. | 204/197 |
| 5,747,983 A | * | 5/1998 | Lara et al. | 324/71.1 |
| 5,835,332 A | | 11/1998 | White et al. | 361/220 |
| 5,968,339 A | | 10/1999 | Clear | 205/730 |
| 6,160,403 A | * | 12/2000 | Kajiyama | 324/425 |
| 6,224,743 B1 | | 5/2001 | Satyanarayana | 205/740 |
| 6,477,027 B1 | * | 11/2002 | McKelvy | 361/220 |
| 6,774,814 B2 | * | 8/2004 | Hilleary | 340/870.07 |

OTHER PUBLICATIONS

Plattline, "Zinc Ribbon Anodes," The Maintenance–free Method for Underground or Underwater Corrosion control, Platt Bros & Col, Inc., Apr. 1998 (4 pgs.).

Platt Zinc Products That Protect—Since 1797, Platt Bros. & Co, Inc. Apr. 1998 (1 pg).

Corrosion Protection of Above Ground Storage Tank Bottoms, The Platt Brothers & Company, Inc. Apr. 1998 (4 pgs.).

* cited by examiner

*Primary Examiner*—Bruce F. Bell
(74) *Attorney, Agent, or Firm*—Robert C. Kain, Jr.; Fleit Kain

(57) ABSTRACT

A prefabricated ground mat with cathodic protection adapted to protect persons from induced electrical potentials in a pipe or other electrical conductor buried below a ground-level surface, adapted to protect test stands, valve sites, metering stations, pig launchers and receivers, access portals, or other exposed, above-ground equipment which are electrically connected to the buried conductor, from such electrical potentials, and adapted to protect the buried conductor from oxidation due to the ground grid. Multiple mats may be buried between the underground conductor and the ground-level surface and electrically connected to either the underground conductor, the above-grade buried conductor, or both. The mats are made of materials such that the galvanic cell formed by the electrical union of the underground conductor with the mat cause the mat to be consumed. The present invention includes a method of protecting persons and exposed, above-grade equipment from induced electrical potentials in the buried conductor.

28 Claims, 3 Drawing Sheets

PROTECTIVE GROUND MAT FOR INDUCED POTENTIALS AND METHOD THEREFOR

This is a regular patent application based upon and claiming priority of a provisional patent application Ser. No. 60/385,382, filed on Jun. 3, 2002.

The present invention relates to a prefabricated ground mat made of anode material for protection of persons coming in proximity of equipment electrically connected to underground conductors in order to mitigate the effect of induced electrical potentials on the underground conductors in the vicinity of such equipment. The ground mat is also designed to protect the underground conductor from further corrosion resulting from being electrically coupled to the ground mat.

BACKGROUND OF THE INVENTION

The mitigation of induced electrical potentials on underground pipes and other electrical conductors has been addressed by others in the past. The induced electrical potentials on these underground pipes and conductors can be caused by a myriad of sources, including electrical currents and electrical potentials caused by the transmission of power through the underground pipe itself, electrical potentials from nearby transmission cables or overhead transmission lines, radio transmission antenna or towers, and other similar sources. The electrical potentials induced on underground pipes and other underground conductors may be extremely dangerous to persons coming in close proximity to the underground conductor. A person coming within close proximity may provide an electrical path to an area of lesser electrical potential causing a discharge of the electrical potential in the buried conductor such that the person is electrocuted.

Utility workers, in particular, regularly face the danger of electrocution from electrical potentials and induced alternating currents from transmission cables and induced potentials on underground conductors such as gas pipes. Most buried pipes and buried transmission cables have equipment connected to the buried conductor which is used to monitor, test, or perform maintenance and repairs to the underground conductor. For example, some underground gas pipes have metering stations throughout the length of the pipe to monitor the flow of gas. Some electrical transmission cables have metering stations to monitor oil pressure and oil temperature in the transmission cable and to detect fault conditions. These stations are typically above grade, at a ground-level surface above the buried conductor and may include access to the buried conductor or may include equipment which is connected to the buried conductor. Often times, the connections to the buried conductor are themselves conductors. For example, some underground utilities require test stands, valve sites, metering stations, pig launchers and receivers, access portals, or other exposed, above-ground equipment which are electrically connected to the underground conductor.

In order to protect persons coming in proximity to or contact with the underground conductor or with any such exposed, above-ground equipment, it is necessary to mitigate the magnitude of the electrical potentials at these sites. Sometimes it is also important to mitigate these electrical potentials to avoid damage to sensitive equipment used in close proximity to an underground conductor.

Prior technology to reduce electrical potentials at such access sites have included the use of grounding rods and interconnecting conductors typically custom made by workers at the desired location. This type of protective scheme led to the use of gradient control wires or conductors. Gradient control wires are set up in a matrix or array near the area needing mitigation of electric potentials. The gradient control wires act on electric potentials in the soil and earth surrounding the buried gradient control wires to bring the electric potential in the area around the wires closer to the potential of the underground conductor. This decreases the electric potential between the underground conductor and the surrounding soil near the buried wires. Hence, the voltage measured between the buried conductor and the work area are brought within acceptable, safe levels.

The use of a matrix of gradient control wires has been used and is known in the art. For example, U.S. Pat. No. 4,114,977 to Polidori discloses a connector for joining grounding grid wires at their nodal points of intersection. The grounding grids consist of a matrix or crossover network of conductors buried underground and connected to above ground equipment and buried grounding rods. Such grounding grids also serve to quickly dissipate fault current as well as induced currents.

Another example of a custom made gradient control grid is one sold by Platt Brothers & Co., Inc. This company produces a PLATTLINE zinc ribbon used to dissipate induced currents on underground pipes. The PLATTLINE zinc ribbon product may be installed in a grid-like configuration by laying out cut lengths of the ribbon in a grid pattern and then the points of intersection are either crimped together with copper rings or welded in place.

However, the use of gradient control wires and grids for step voltage and touch voltage mitigation has always involved the custom installation of the wires by workers in the field. It has involved cutting conductors and custom building the matrix or array of gradient control wires at location. There is a need for a gradient control system whereby a prefabricated array or matrix can be easily installed between underground conductors and surface-level equipment to mitigate induced electrical potentials and currents. There is a need for a gradient control system that does not require the manufacture of the grid at location. There is also a need for a gradient control ground grid that provides both electric potential mitigation and cathodic protection to the underground conductor to which it is electrically connected.

OBJECTS OF THE INVENTION

It is an object of the present invention to provide a prefabricated grounding grid with cathodic protection to protect persons from induced electrical potentials in a pipe or other electrical conductor buried below a ground-level surface through mitigation of such potentials in a volume of space near the grid.

It is another object of the present invention to provide a prefabricated grounding grid with cathodic protection to protect test stands, valve sites, metering stations, pig launchers and receivers, access portals, or other exposed, above-ground equipment which are electrically connected to an underground pipe or other buried conductor from induced electrical potentials and currents.

It is a further object of the present invention to provide a prefabricated grounding grid with cathodic protection which protects buried conductors from oxidation due to the ground grid.

It is an object of the present invention to provide a prefabricated, substantially planar pre-formed mat having a predetermined pattern of intersecting and electrically connected anode material for burial underground between a buried conductor and equipment at a ground-level surface generally above the buried conductor.

It is another object of the present invention to electrically connect a buried prefabricated grounding mat to exposed, above-ground equipment generally located over a buried conductor such that any electrical potentials emanating or originating from the buried conductor whether or not induced by other sources are mitigated in a volume of space near the mat to make areas in proximity to the mat safe for persons and sensitive equipment.

It is a further object of the present invention to provide a prefabricated electrical potential mitigating mat having a pattern of intersecting and electrically connected anode material defining predetermined polygonal shapes having predetermined dimensions.

It is yet another object of the present invention to provide a prefabricated electrical potential mitigating mat with cathodic protection which is coated with an aluminum alloy to slow the oxidation rate of the mat.

It is another object of the present invention to provide a system to create a safe environment for persons and equipment above buried conductors such that induced electrical potentials and induced currents present on the buried conductors are mitigated by providing a plurality of interconnected prefabricated planar mats having a predetermined pattern of intersecting and electrically connected anode material adapted to be buried between the buried conductor and a ground-level surface above the buried conductor.

It is a further object of the present invention to provide a method of protecting persons and exposed, above-ground equipment from induced electrical potentials in a pipe or other electrical conductor below a ground-level surface by providing at least one substantially planar, pre-formed cathodic mat having a predetermined pattern of intersecting and electrically connected anode material, burying the mat underground between the ground-level surface and the pipe or other electrical conductor, and electrically connecting the mat with the exposed, above-ground equipment.

SUMMARY OF THE INVENTION

The present invention includes a prefabricated, preformed substantially planar mat made of an anode material, thus providing cathodic protection, which is used to protect persons from induced electrical potentials in a pipe or other electrical conductor buried below a ground-level surface, and which is also used to protect test stands, valve sites, metering stations, pig launchers and receivers, access portals, or other exposed, above-ground equipment which are electrically connected to the buried conductor, from such electrical potentials. There may be a plurality of such mats electrically connected together. Each pre-formed mat has a predetermined pattern of intersecting and electrically connected anode material which define voids between the anode material, such as a diamond shape or other polygonal shape. The preformed mats are buried underground between the ground-level surface and the buried conductor. The mats are electrically connected to the exposed, above-ground equipment either directly or viz-a-viz a conductor connected to the underground conductor already electrically connected to the above-ground equipment. This configuration promotes mitigation of the electrical potentials in a volume of space near the mat. The mats should be positioned below the ground-level surface such that a plane defined by the planar pre-formed mat is substantially parallel with a plane defined by the surface. The surface need not be level. The mats should not be buried more than 2 feet below the ground-level surface.

The mats may be coated with an aluminum alloy material to slow the oxidation rate of the mat.

The present invention includes a method of protecting persons and exposed, above-ground equipment from induced electrical potentials in the underground conductor.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a prefabricated ground mat made of anode material for protection of persons coming in proximity of equipment electrically connected to underground conductors in order to mitigate induced electrical potentials in the vicinity of such equipment. The ground mat is also designed to protect the underground conductor from further corrosion resulting from being electrically coupled to the ground mat. In addition, the electrical potential mitigating property protects equipment sensitive to induced potentials and electric currents.

Figure 1:
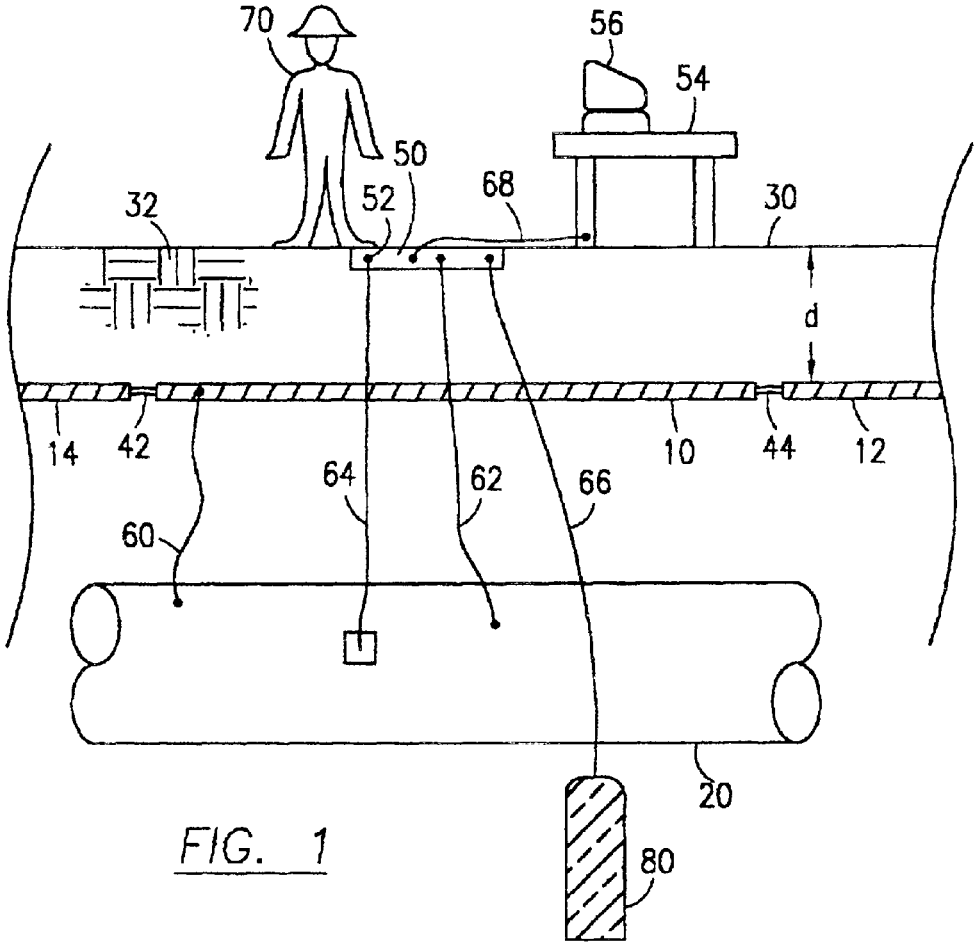
FIG. 1 diagrammatically illustrates a side view of the prefabricated ground mat installed underground for protection of persons coming in proximity of equipment electrically connected to the underground pipe.

FIG. 1 diagrammatically illustrates the present invention. In FIG. 1, the prefabricated ground grid 10 is shown from a side view. The ground grid 10 is a substantially planar pre-formed mat having a predetermined pattern of intersecting and electrically connected anode material (described later in connection with FIGS. 2B and 4). The anode material is typically zinc but may be made of any conductive material having a more active electrochemical potential than that of the steel, cast iron and other ferrous materials to which the mat is electrically connected. Typically, underground pipes or other underground conductors are made of steel, cast iron or other ferrous metal. Because the mat 10 is electrochemically more active than the metal structures to which it is electrically connected, the galvanic cell formed by these two electrical conductors will consume the mat 10 rather than corrode the underground conductor structure. The pre-formed mat 10 in FIG. 1 is connected to mats 12, 14 on either side via electrical couplers 42, 44. Electrical couplers 42, 44 may be flexible conductors such as wire, solid metal straps, braided straps, or may be rigid straps or other conductive material. The electrical couplers 42, 44 may be fastened or otherwise attached to the mats 10, 12, 14 by means known to those skilled in the art such as by bolt, clamp, weld, or the like. In one embodiment, the connections are made using insulated heavy gauge copper wire.

In FIG. 1, the pre-formed mat 10 is buried underground between the ground-level surface 30 and the underground conductor 20. The underground conductor 20 in FIG. 1 is shown as a pipe. As discussed above in the background of the invention, the underground conductor 20 may be a power transmission cable, a gas or oil pipe, or any other conductive utility pipe. The surface 30 in FIG. 1 is illustrated substantially level. However, the ground-level surface need not be level. It may be curved or graded, depending upon the topography of the location. The ground-level surface refers to the surface of the ground at a level where persons may be in contact or in close proximity to equipment used to access, monitor, repair or otherwise work near underground conductors. Accordingly, a ground-level surface may be a right-of-way ditch where utilities may be found, for example, on the side of a road.

The earth 32 below the ground-level surface 30 may be the naturally occurring mixture of soil and rocks, or may have been replaced with rocks or soil having a predetermined conductivity and/or drainage capability.

In FIG. 1, mat 10 is electrically connected to underground pipe 20 via electrical conductor 60. Electrical conductor 60 may also be a flexible conductor such as a wire, solid metal strap, braided strap, or may be a rigid strap or other conductive material. The connection between electrical conductor 60 and mat 10 and pipe 20 may be made through any means known to those skilled in the art such as by bolt, clamp, weld, or the like. Although only one conductor 60 is shown, more than one conductor may be used. For example, each of mats 10, 12, and 14 may include a separate conductor electrically connecting the respective mat to the buried pipe 20.

Underground pipe 20 in FIG. 1 is electrically connected to a flush-mounted or surface mounted test station 50 via another electrical conductor 62. Electrical conductor 62 is similar to and may be connected in the same manner as described above in connection with electrical conductor 60. Test station 50 provides personnel 70 above the underground conductor 20 with access to test ports which provide information regarding the state of the underground conductor. For example, access port 52 may be a valve port connected to pipe 20 via line 64 giving access to the gas or liquid in the pipe. Access port 52 may be a monitoring port to which sophisticated monitoring equipment may be connected which utilizes information sent via cable 64. In yet another example, line 64 may be a thermocouple test wire which a person 70 may use to gather information regarding the condition of pipe 20 and the contents of the pipe.

Test stand 50 may also be connected to a sacrificial anode 80 to provide the test stand and other electrically attached equipment with cathodic protection. For example, in FIG. 1, test stand 50 is connected to a magnesium anode 80 via electrical conductor 66.

Figure 2A:
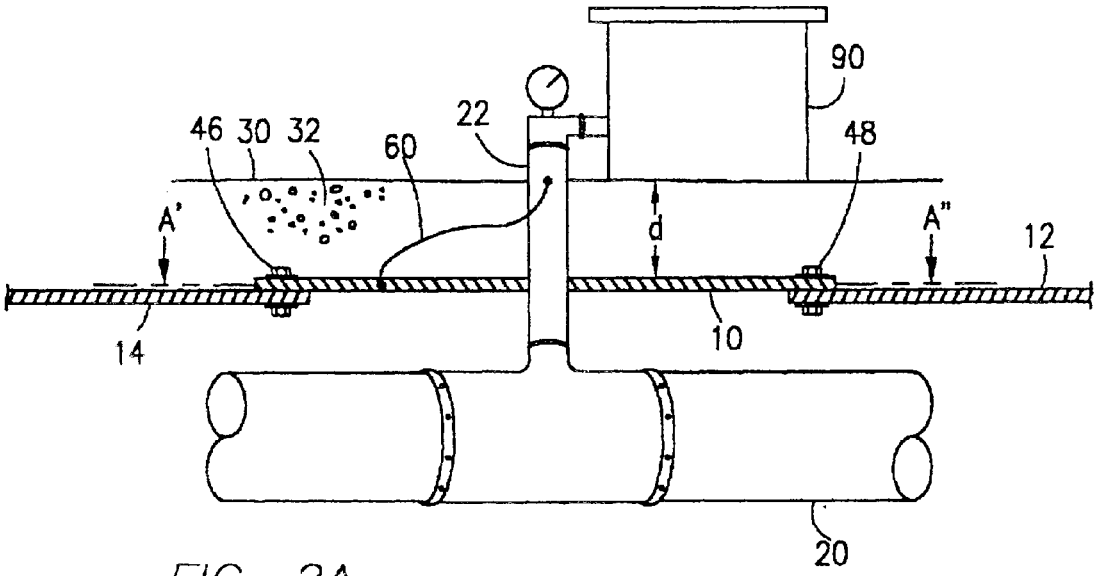
FIG. 2A diagrammatically illustrates another installation configuration of the prefabricated ground mat.

In FIG. 1, flush-mounted test stand 50 is shown connected to table 54 via grounding cable 68. Table 54 is shown with monitoring equipment 56 above. This depiction is merely exemplary, as there are many configurations which may occur, depending upon the environment, the type of underground conductor 20, the reason for the station, and the proximity to the underground conductor or pipe. There may be a control house 90 above the location, or the pipe may have an access pipe 22 rising from the main conduit as shown in FIG. 2A. Similar features and components have been given the same reference numerals throughout the drawings.

In FIG. 2A, underground pipe 20 has a pipe riser 22 giving access at the ground-level surface 30. Riser 22 may be a pig launcher or similar access port for a pipeline.

Figure 2B:
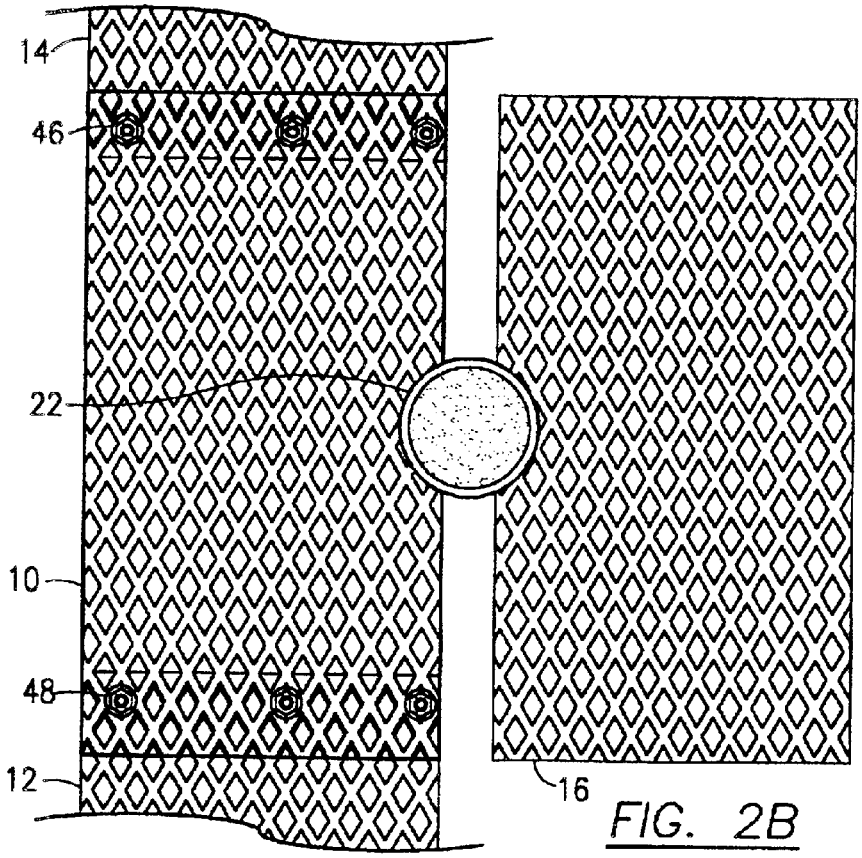
FIG. 2B diagrammatically illustrates a top view of the installed prefabricated ground mat from the perspective of section line A'A" in FIG. 2A.

Preformed mats 10, 12, 14 are shown buried underground at a depth d. Depth d is typically 18 to 24 inches. Preferably, the preformed mats are buried 18 to 24 inches deep, that is, the mats are not buried deeper than, substantially 24 inches. In FIGS. 2A and 2B, Mats 10 and 12 are overlapping and attached via electrical couplers 48. Electrical couplers 46, 48 may be a bolt, rivet, weld or other system to connect mat 10 to mats 12 and 14. In FIG. 2A, mat 10 is electrically connected to the riser 20 via conductor 60.

FIG. 2B diagrammatically illustrates a top view of the installed prefabricated ground mat 10 from the perspective of section line A'A". In FIG. 2B, preformed mat 10 is overlapping preformed mats 12 and 14. The typical overlap is approximately 3 to 4 inches. Electrical couplers 46, 48 are shown as bolts with washers. In FIG. 2B, another mat 16 is present on the other side of the pipe riser 22. The preformed mats 10, 12, 14, and 16 have a diamond pattern, i.e., the pattern of intersecting and electrically connected anode material of the mat define diamond shaped holes. The pattern of the anode mats may be designed for different applications. For example, some soils are more conductive than others requiring less surface area on the pre-formed mat 10. It may also be desirable to have less surface area to inhibit the rate of consumption of the mat.

Figure 3:
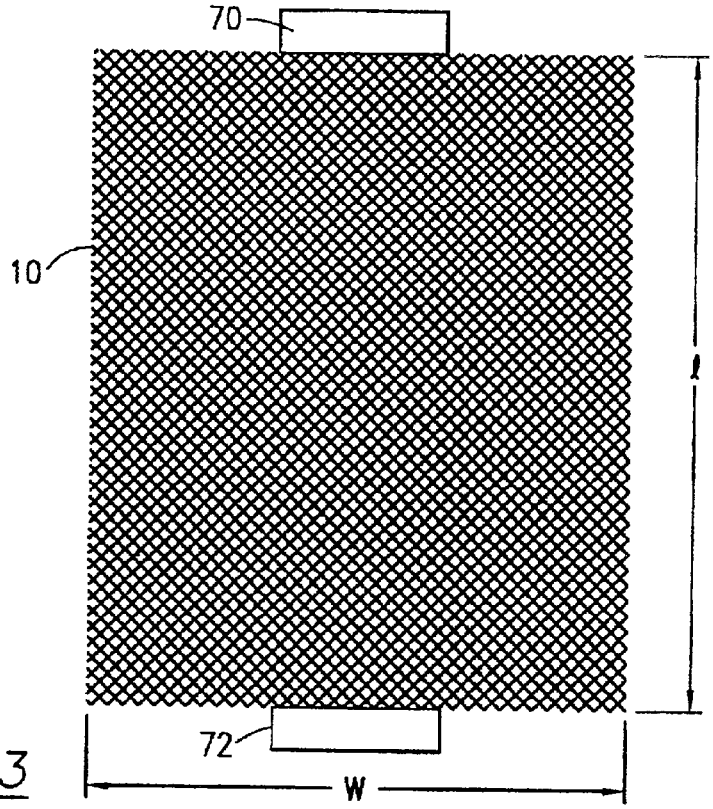
FIG. 3 diagrammatically illustrates a planar, pre-formed zinc mat having a diamond pattern of intersecting and electrically connected anode material.

FIG. 3 diagrammatically illustrates another embodiment of the mat 10 having a mesh-like pattern. Mat 10 has a width w and a length l. The dimensions of the mats vary, but are typically 4½ feet wide by 9 feet in length. Mat 10 in FIG. 3 has insulated electrical couplers 70, 72 on either end of the mat. These couplers are used to join a plurality of mats laid side by side.

Figure 4:
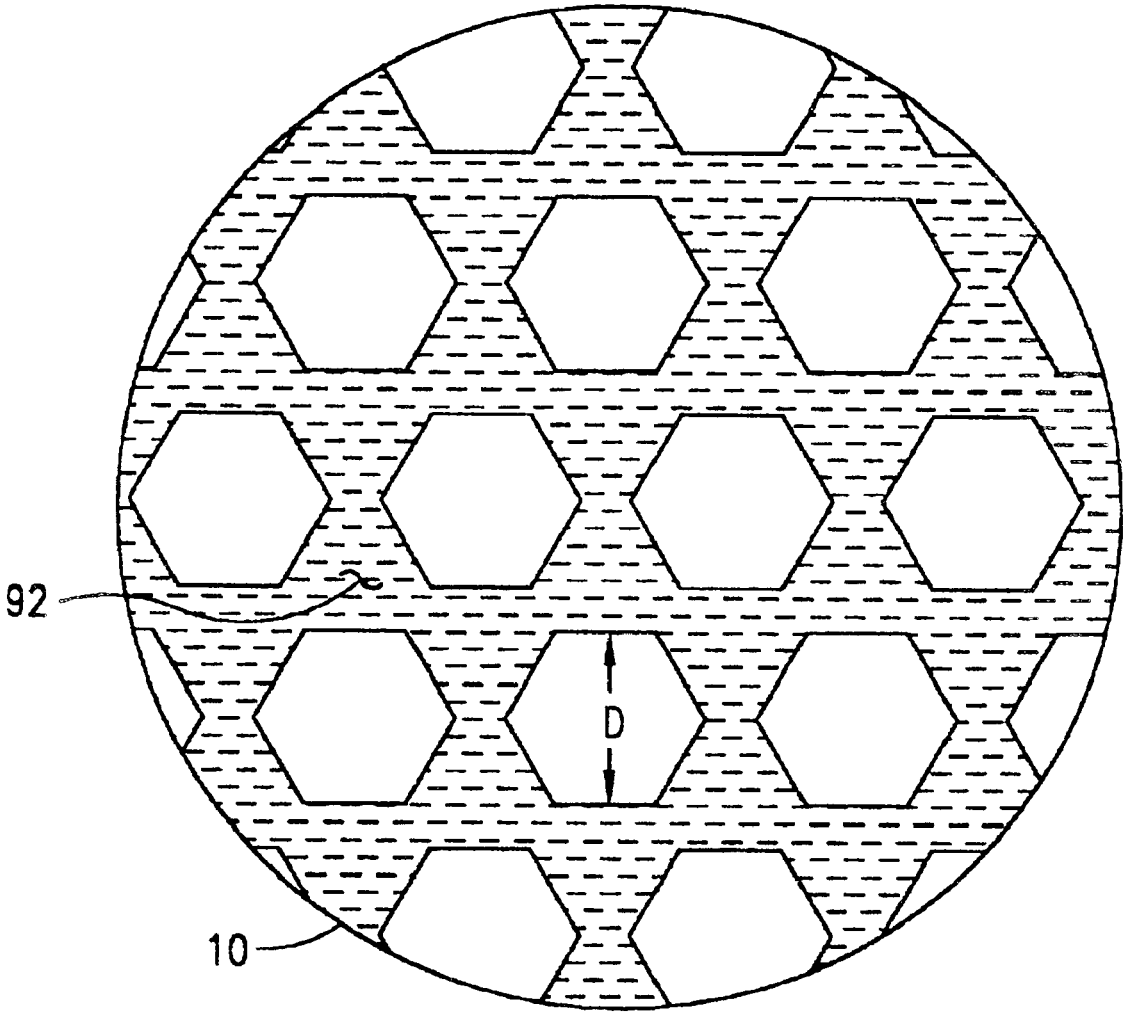
FIG. 4 diagrammatically illustrates an enlarged view of the prefabricated mat with a coating of aluminum alloy.

FIG. 4 diagrammatically illustrates an enlarged view of the pre-formed mat 10 defining hexagonal-shaped holes. The holes can vary in size, but have a typical dimension D of ½ inch. Other mat designs defining multi-sided or polygonal shaped holes may also be implemented. The mats 10 may be manufactured by stamping holes into large planar sheets of the zinc material. The mats may be treated with chemicals or coated with special paints to inhibit the rate of consumption of the mat. For example, in FIG. 4, zinc mat 10 has been coated with an aluminum alloy paint mixture 92 which inhibits the consumption rate of the underlying zinc material. This protective coating is especially useful in applications where the soil exhibits high conductivity properties.

The preformed grounding mat 10 is easy to install, cost-effective, and provides a safe zone of mitigated induced electrical potentials. For a typical site, an area approximately 10 feet by 10 feet is excavated around the above-grade structure to a depth of 1 to 1½ feet. Two 4½×9 feet sections of mat 10 are laid out on either side of the above-grade structure to be grounded. For example, in FIGS. 2A and 2B, mats 10 and 16 are laid out on either side of pipe riser 22. The areas of the mats 10 immediately surrounding the above-grade structure are removed by either snipping or melting away. When fitting the mats around the above-grade structure, enough material of the mat 10 should be removed such that the mats overlap by approximately 3 inches. Spacing between the above-grade structure and the surrounding mats should be approximately 1 to 2 inches. For the mats 10 having diamond-shaped voids, the mats 10 should overlap such that the diamond-shaped voids align. Using stainless steel bolts, washers and nuts, the overlapping mats should be fastened together by passing the bolt through the diamond-shaped void in the overlapping areas. The bolts should not be over-tightened. In the preferred embodiment the bolts should be placed at approximately 1 foot intervals along the overlap. After tightening the bolts, an insulating patch is placed above and below each of the nut and bolt fastener so that an area around each bolt is protected from the surrounding soil.

Once the mats are secured together, the mats are electrically connected to the above-grade structure. In FIG. 2A, the mat 10 is electrically connected to pipe riser 22. However, the mat 10 may be connected to the test station 50 in FIG. 1. Alternatively, the mat 10 is electrically connected to the underground conductor 20 (as shown in FIG. 1), or may be connected to both the above-grade structure 22 or 50 and the buried conductor 20. Again, these connections may be through a heavy gauge wire or the like. In the preferred embodiment, the connection points are covered with an insulative material so as to protect the mat 10 in the areas immediately around the connection from being consumed first.

The above-described method of installing the preformed mats 10 is exemplary. There are numerous means to connect the mats together, including that shown in FIG. 1 where the mats 10, 12 and 14 do not overlap, and instead are connected together via electrical connectors 42, 44. Similarly, the electrical connectors between the mat or plurality of mats may also be embodied in numerous conductors, as described earlier.

The claims appended hereto are meant to cover modifications and changes within the scope and spirit of the present invention.

What is claimed is:

1. A prefabricated ground grid with cathodic protection adapted to protect persons from induced electrical potentials in a pipe or other electrical conductor buried below a ground-level surface, adapted to protect test stands, valve sites, metering stations, pig launchers and receivers, access portals, or other exposed, above-ground equipment which are electrically connected to the buried conductor, and adapted to protect said buried conductor from oxidation due to the ground grid, the grid comprising:

at least one substantially planar pre-formed mat having a predetermined pattern of intersecting and electrically connected anode material adapted to be buried underground between said ground-level surface and said buried conductor;

at least one electrical conductor electrically connecting said mat and the exposed, above-ground equipment such that said electrical potentials are mitigated in a volume of space near said mat.

2. A ground grid as claimed in claim 1 wherein said mat is positioned below said surface such that a plane defined by said planar pre-formed mat is substantially parallel with a plane defined by said surface.

3. A ground grid as claimed in claim 2 wherein said mat is buried a depth no deeper than substantially 24 inches.

4. A ground grid as claimed in claim 1 wherein said pattern of intersecting and electrically connected anode material of said pre-formed mat defines predetermined polygonal shapes having predetermined dimensions.

5. A ground grid as claimed in claim 1 wherein said pre-formed mat is a mesh defining small diamond-shaped spaces.

6. A ground grid as claimed in claim 1 wherein said pre-formed mat includes an aluminum alloy coating to slow the oxidation rate of said mat.

7. A ground grid as claimed in claim 1 further comprising a plurality of said mats and at least one electrical coupler electrically connecting each mat of said plurality of said mats to an adjacent mat such that there is electrical continuity between all said mats.

8. A ground grid as claimed in claim 7 wherein said plurality of mats is positioned below said surface such that a plane defined by said plurality of planar pre-formed mat is substantially parallel with a plane defined by said surface.

9. A ground grid as claimed in claim 8 wherein said plurality of mats is buried a depth no deeper than substantially 24 inches.

10. A ground grid as claimed in claim 9 wherein said pattern of intersecting and electrically connected anode material of each said pre-formed mat defines predetermined polygonal shapes having predetermined dimensions.

11. A ground grid as claimed in claim 9 wherein each said pre-formed mat is a mesh defining small diamond-shaped spaces.

12. A ground grid as claimed in claim 10 wherein each said pre-formed mat includes an aluminum alloy coating to slow the oxidation rate of said mat.

13. In combination with a pipe or other electrical conductor buried below a ground-level surface, a prefabricated ground grid with cathodic protection adapted to protect persons from induced electrical potentials, the grid adapted to be installed in combination with said pipe or other electrical conductor and adapted to protect test stands, valve sites, metering stations, pig launchers and receivers, access portals, or other exposed, above-ground equipment which are electrically connected to the buried conductor, from said electrical potentials, and adapted to protect said buried conductor from oxidation due to the ground grid, the grid comprising:

at least one substantially planar pre-formed mat having a predetermined pattern of intersecting and electrically connected anode material adapted to be buried underground between said ground-level surface and said buried conductor;

at least one electrical conductor electrically connecting said mat and the exposed, above-ground equipment such that said electrical potentials are mitigated in a volume of space near said mat.

14. A ground grid as claimed in claim 13 wherein said mat is positioned below said surface such that a plane defined by said planar pre-formed mat is substantially parallel with a plane defined by said surface.

15. A ground grid as claimed in claim 14 wherein said mat is buried a depth no deeper than substantially 24 inches.

16. A ground grid as claimed in claim 13 wherein said pattern of intersecting and electrically connected anode material of said pre-formed mat defines predetermined polygonal shapes having predetermined dimensions.

17. A ground grid as claimed in claim 13 wherein said pre-formed mat is a mesh defining small diamond-shaped spaces.

18. A ground grid as claimed in claim 13 wherein said pre-formed mat includes an aluminum alloy coating to slow the oxidation rate of said mat.

19. A ground grid as claimed in claim 13 further comprising a plurality of said mats and at least one electrical coupler electrically connecting each mat of said plurality of said mats to an adjacent mat such that there is electrical continuity between all said mats.

20. A ground grid as claimed in claim 19 wherein said plurality of mats is positioned below said surface such that a plane defined by said plurality of planar pre-formed mat is substantially parallel with a plane defined by said surface.

21. A ground grid as claimed in claim 20 wherein said plurality of mats is buried a depth no deeper than substantially 24 inches.

22. A ground grid as claimed in claim 21 wherein said pattern of intersecting and electrically connected anode material of each said pre-formed mat defines predetermined polygonal shapes having predetermined dimensions.

23. A ground grid as claimed in claim 21 wherein each said pre-formed mat is a mesh defining small diamond-shaped spaces.

24. A ground grid as claimed in claim 22 wherein each said pre-formed mat includes an aluminum alloy coating to slow the oxidation rate of said mat.

25. A method of protecting persons and exposed, above-ground equipment from induced electrical potentials in a pipe or other electrical conductor below a ground-level surface, the method comprising:

providing at least one substantially planar, pre-formed cathodic mat having a predetermined pattern of intersecting and electrically connected anode material;

burying said at least one mat underground between said ground-level surface and said pipe or other electrical conductor; and electrically connecting said mat with said exposed, above-ground equipment.

26. A method as claimed in claim 25 further comprising the steps of burying a plurality of said mats adjacent each other, and electrically connecting the buried plurality of mats such that there is electrical continuity between all said mats.

27. A method of protecting persons and exposed, above-ground equipment from induced electrical potentials in a pipe or other electrical conductor below a ground-level surface, the method comprising:

providing at least one substantially planar, pre-formed cathodic mat having a predetermined pattern of intersecting and electrically connected anode material;

burying said at least one mat underground between said ground-level surface and said pipe or other electrical conductor;

electrically connecting said mat with said exposed, above-ground equipment; and electrically connecting said mat with said pipe or other electrical conductor.

28. A method as claimed in claim 27 further comprising the steps of burying a plurality of said mats adjacent each other, and electrically connecting the buried plurality of mats such that there is electrical continuity between all said mats.

* * * * *